US008622321B2

(12) United States Patent
Vandaele

(10) Patent No.: US 8,622,321 B2
(45) Date of Patent: Jan. 7, 2014

(54) APPARATUS FOR PRESERVING AND SERVING BY-THE-GLASS WINE, OR OTHER LIQUID THAT CAN BE AFFECTED BY OXYGEN

(75) Inventor: Jacques Valere Vandaele, West Flanderen (BE)

(73) Assignee: Winefit S.R.L., Calenzano (IT)

( * ) Notice: Subject to any disclaimer, the term of this patent is extended or adjusted under 35 U.S.C. 154(b) by 464 days.

(21) Appl. No.: 13/063,120

(22) PCT Filed: Sep. 11, 2008

(86) PCT No.: PCT/IB2008/002363

§ 371 (c)(1),
(2), (4) Date: Mar. 29, 2011

(87) PCT Pub. No.: WO2010/029381

PCT Pub. Date: Mar. 18, 2010

(65) Prior Publication Data

US 2011/0180631 A1 Jul. 28, 2011

(51) Int. Cl.

| | |
|---|---|
| ***B05B 7/32*** | (2006.01) |
| ***F23D 11/24*** | (2006.01) |
| ***F23D 14/28*** | (2006.01) |
| ***F23D 14/34*** | (2006.01) |

(52) U.S. Cl.
USPC ..... 239/373; 239/337; 239/310; 239/368; 96/4

(58) Field of Classification Search
USPC ..... 239/337, 373, 302, 310, 311, 368; 96/4
See application file for complete search history.

(56) References Cited

U.S. PATENT DOCUMENTS

| | | | | |
|---|---|---|---|---|
| 3,653,557 | A * | 4/1972 | Lamb | 222/400.7 |
| 3,802,606 | A * | 4/1974 | Gust | 222/484 |
| 4,595,121 | A * | 6/1986 | Schultz | 222/1 |
| 4,706,847 | A * | 11/1987 | Sankey et al. | 222/1 |
| 4,809,884 | A * | 3/1989 | Stackhouse | 222/153.04 |
| 5,465,875 | A * | 11/1995 | Garnett | 222/148 |
| 8,490,832 | B2 * | 7/2013 | Lambrecht | 222/82 |

FOREIGN PATENT DOCUMENTS

| | | |
|---|---|---|
| FR | 2616767 | 12/1988 |
| GB | 2217787 | 11/1999 |

* cited by examiner

*Primary Examiner* — Len Tran
*Assistant Examiner* — Justin Jonaitis
(74) *Attorney, Agent, or Firm* — Ladas & Parry LLP

(57) ABSTRACT

Device (100) for preserving and serving, from a bottle, by-the-glass liquid that can be affected by oxygen such as wine, by pumping pressurized inert gas in a bottle (40'). The device comprises a coupling portion (10) adapted to couple with a pressurized gas supply, a central body (20), and a fastening portion (30) to the bottle (40'), in particular, to a bottle neck (40). The central body (20) provides an inlet duct (21) of the pressurized gas, associated with an inlet valve (24), and a delivery duct (22) of the liquid, associated with a delivery valve (25), which draws the liquid from the bottle (40') and brings it to a delivery mouth (23). In particular at least one among the inlet valve (24) and the delivery valve (25) is a pilot valve, which is piloted by the pressure of the inert gas. Furthermore, a pilot channel (26), (29) is provided communicating with a pilot port (27), (28) present in the coupling portion (10) and communicating with the pilot valve.

9 Claims, 8 Drawing Sheets

APPARATUS FOR PRESERVING AND SERVING BY-THE-GLASS WINE, OR OTHER LIQUID THAT CAN BE AFFECTED BY OXYGEN

FIELD OF THE INVENTION

The present invention describes a device for preserving and serving by-the-glass wine, or other liquid that can be affected by oxygen, from a bottle.

In particular, the invention relates to the field of enology and is adapted to be used in cellars, wine shops, bars, restaurants or places for by-the-glass wine tasting. This way, organoleptic features of the wine are preserved.

DESCRIPTION OF THE TECHNICAL PROBLEM

Devices are known for preserving wine, or other liquid that can be affected by oxygen in bottles, that operates either under vacuum or by means of inert gas, for already open wine bottles. The main object of such apparatus is to preserve, for the longest time possible, the organoleptic features of wine that, as well known, change after contact with oxygen present in the environment.

This kind of devices comprises, normally, a plug which can be fixed to the opening of a bottle and which is equipped with a check valve that allows the air or gas flow according in a single direction, for causing the suction of air or the supply of an inert gas inside.

With reference to the latter kind of apparatus, which use a inert fluid against the alteration of wine, special devices for the supply of wine are used that exploit a variation of the pressure in the bottle.

In particular, such apparatus provide a releasable fastening member engageable with the opening of a bottle, a thin delivery tube that draws wine from the bottle, and a gas injection duct that pumps in the bottle a pressurized gas, for example an inert gas such as nitrogen or argon; the increasing pressure in the bottle causes the wine to exit from the thin delivery tube. Once ended the delivery of wine the device prevents the air to exit from the bottle by a check valve.

In particular, the valve, in the known devices, comprises an "a mushroom" element, or in other exemplary embodiments a couple of lips, coupled to each other, in a normally closed configuration. In the first case, the pressure difference, applied by the gas supply apparatus causes the element to slide from a position, where it blocks the gas duct to a gas inlet position. In the other case, according at a same operation, the blades pass from an open position to a closed position causing the inert gas or air to flow by suction from the inside of the bottle.

The drawbacks of such apparatus are, firstly, in the components, since lips or "mushroom" valves loose their functionality with time thus affecting partially or completely the tightness and then allowing the oxygen to flow inside.

In addition to this aspect also low functionality of such valves is present, since for keeping a positive pressure, even if low, in the bottle a perfect tightness has to be achieved that is not ensured by a single seal element represented by the valve.

SUMMARY OF THE INVENTION

It is then a general object of the present invention to provide a device for preserving and serving wine, or other liquid that can be affected by oxygen, which improves the efficiency and the functionality of the known devices.

It is also a feature of the present invention to provide a device for preserving and serving wine, or other liquid that can be affected by oxygen, which allows keeping a positive pressure in the bottle.

Another feature of the present invention is to provide a device for preserving and serving wine, or other liquid that can be affected by oxygen, which is structurally easy and reliable with time.

These and other objects are achieved by a device for preserving and serving, from a bottle by-the-glass liquid that can be affected by oxygen, in particular wine, by pumping pressurized inert gas into said bottle, said bottle having a neck with an inlet mouth, said device comprising:

a coupling portion with a pressurized gas supply, a central body, and a fastening portion to said bottle adapted to engage with said inlet mouth, said body having:

a pressurized gas inlet duct, ending in said bottle, communicating with an inlet port present on said coupling portion, and a liquid delivery duct, which draws the liquid from the bottle and brings it to a delivery mouth, wherein to said inlet duct an inlet valve is associated, adapted to open said inlet duct when delivery of liquid is requested and to stop said inlet duct to prevent the inert gas to enter the bottle the bottle when delivery of liquid is not requested, and wherein to said delivery duct a delivery valve is associated, adapted to open said delivery duct when delivery of liquid is requested and to stop said delivery duct and to prevent the liquid to exit from the bottle when delivery of liquid is not requested, characterised in that at least one among said inlet valve and said delivery valve is a pilot valve, which is piloted by the pressure of said inert gas, and in that a pilot channel is provided communicating with a pilot port present in said coupling portion and communicating with said pilot valve.

This way, when said coupling portion couples with said pressurized gas supply, said gas enters at the same time in said pilot channel through said pilot port, and in said inlet duct.

In a first case, said pilot valve of said inert gas is said inlet valve. This way, when said coupling portion couples with said pressurized gas supply, the gas enters at the same time in the inlet duct and in the pilot channel of the pilot valve, which by the gas pressure opens the inlet duct and allows the inert gas to enter the bottle and then the liquid to go up by the pressure the delivery duct from which it exits; the latter equipped, for example, with a tap.

Alternatively, said pilot valve of said inert gas is said delivery valve. This way, when said coupling portion couples with said pressurized gas supply, the gas enters at the same time in the inlet duct and in the pilot channel of the delivery valve. This way, the gas that has entered the bottle through the inlet duct causes the liquid to go up the delivery duct that is open, and from which it exits.

Advantageously, said inlet valve and said delivery valve are both pilot valves that are piloted by the pressure of the inert gas, having each a respective pilot channel communicating with a respective pilot port. This way, the pressurized gas enters at the same time both the inlet duct and the two pilot channels through the respective pilot ports, which open the inlet duct and the delivery duct.

Advantageously, said pilot valve comprises:

a first chamber connected to said pilot duct from which the gas is supplied;

a second chamber connected to said inlet duct and/or to said delivery duct;

a membrane arranged between said first and second chamber;

a stopper arranged in said second chamber and integral to said membrane;

such that said membrane deforms by the pressure difference between said first and second chamber and moves said stopper from a first position that opens said inlet duct and/or said delivery duct, to a second position that blocks said inlet duct and/or said delivery duct.

This way, when the pressure in the first chamber is higher than that of the second chamber the stopper opens the inlet duct and/or the delivery duct to which it is connected, whereas when the pressure in the first chamber is less than the second chamber the stopper blocks the inlet duct and/or the delivery duct.

Advantageously, in said coupling portion, which is adapted to couple with said gas supply, a recess is made having a plurality of channels that in use connect the inlet port of said inlet duct and said pilot ducts. This way, once connected the coupling portion the gas supply, the gas is fed uniformly in the inlet ports and, furthermore, there is not risk of gas leaks.

In particular, said central body is a box-like body with a housing having a shoulder, said first and second chamber being obtained arranging said membrane on said shoulder, said first chamber being obtained from a plug that tightly engages in said housing and has a recess and an edge, such that in closed position of said plug in said housing said edge presses said membrane against said shoulder, and said first chamber is formed by said recess, whereas the second chamber is formed by the other part of said housing beyond said membrane.

Advantageously, said housing from the side of said second chamber has a hole where said stopper engages, beyond said hole a passage being provided that represents a portion of said inlet duct and/or said delivery duct that said stopper selectively opens or blocks.

Preferably, said coupling portion comprises a flange that slidingly engages with a guide that is made in said pressurized gas supply such that said flange aligns with said inlet duct to enable said gas to pass.

In particular, in said coupling portion, which is adapted to couple with said gas supply, a recess is made having a plurality of channels that in use connect the inlet port of said inlet duct and said pilot ducts.

BRIEF DESCRIPTION OF THE DRAWINGS

The invention will be made clearer with the following description of an exemplary embodiment thereof, exemplifying but not limitative, with reference to the attached drawings wherein:

FIG. 5' shows a cross sectional view according to a plane passing through the delivery valve;

FIG. 7' shows a complete cross sectional view according to a plane passing through the wine delivery duct;

DESCRIPTION OF THE PREFERRED EXEMPLARY EMBODIMENT

Figure 8:
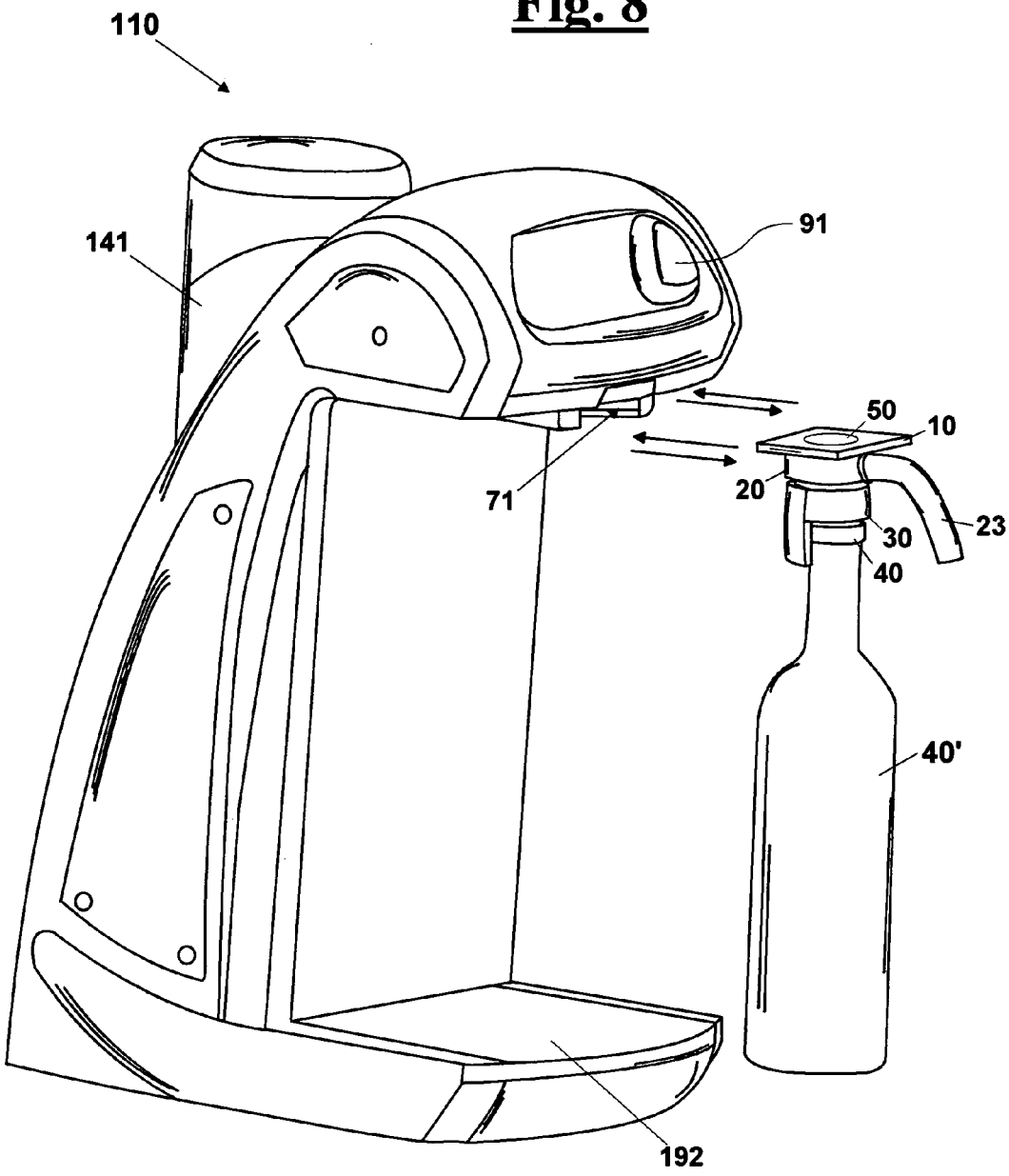
FIG. 8 shows an application of the apparatus according to the invention, to a device that works as pressurized gas supply.

With reference to F*igs*. from 1 to 3, a device 100 is diagrammatically shown for preserving and serving, from a bottle, by-the-glass liquid that can be affected by oxygen such as wine, by pumping pressurized inert gas into a bottle 40' (shown in FIG. 8). In particular, the device 100 comprises a coupling portion 10, which is adapted to tightly couple with a pressurized gas supply (not shown), a central body 20, and a portion 30 for fastening to bottle 40', in particular, to a neck 40 (shown in FIG. 8).

Furthermore, the central body 20 provides a pressurized gas inlet duct 21, ending in bottle 40', and communicating with an inlet port 11 present on coupling portion 10, and a delivery duct 22 for the liquid, which draws the liquid from bottle 40' and brings it to a delivery mouth 23.

Furthermore, to inlet duct 21 an inlet valve 24 is associated, adapted to open inlet duct 21 when delivery of liquid is requested and to stop it to prevent the inert gas to enter bottle 40' when delivery of liquid is not requested, whereas to delivery duct 22 a delivery valve is associated 25, adapted to open delivery duct 22 when delivery of liquid is requested and to stop it and to prevent the liquid to exit from bottle 40' when delivery of liquid is not requested. The main feature of the device 100 is that at least one among inlet valve 24 and delivery valve 25 is a pilot valve, which is piloted by the pressure of the inert gas, and that a pilot channel 26,29 is provided communicating with a pilot port 27,28 present in coupling portion 10 and communicating with the pilot valve.

This way, when coupling portion 10 couples with the pressurized gas supply 110 (shown in FIG. 8), the gas enters at the same time pilot channel 26 or 29, through the respective one among pilot ports 27 or 28, and inlet duct 21.

Figure 1:
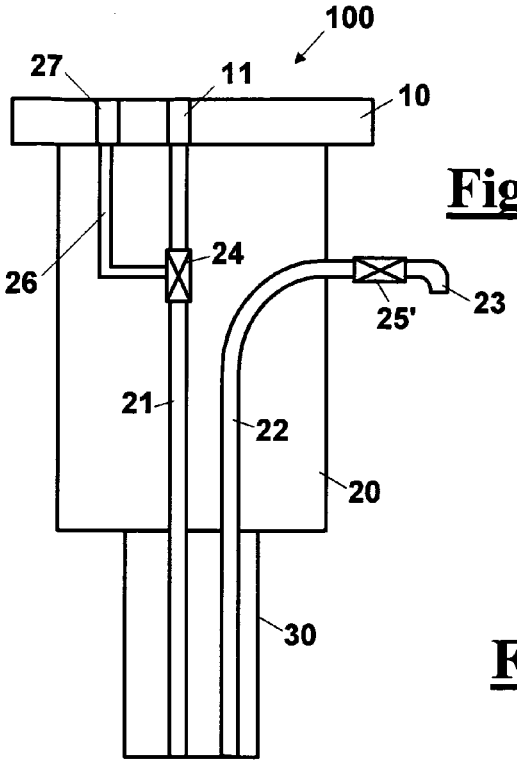
FIG. 1 shows diagrammatically the device for preserving and serving wine, according to a first exemplary embodiment where the inlet valve is a pilot valve, which is piloted by the pressurized gas.

In a first case, shown in FIG. 1, the pilot valve of the inert gas is inlet valve 24. This way, when coupling portion 10 couples with the pressurized gas supply, the gas enters at the same time inlet duct 21 and pilot channel 26 of the pilot valve, which by the gas pressure opens inlet duct 21 and allows the inert gas to enter bottle 40' and then the liquid to go up by the pressure through delivery duct 22 from which it exits; the latter is equipped, for example, with a tap, such as valve 25'.

Figure 2:
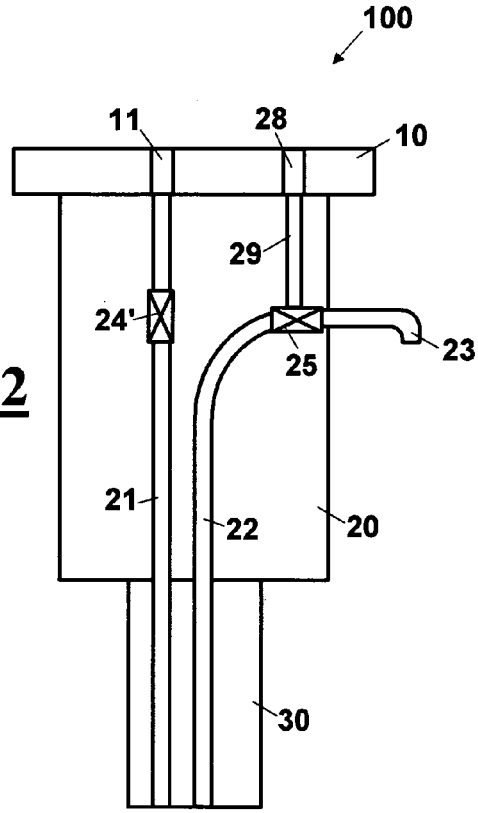
FIG. 2 shows diagrammatically the device for preserving and serving wine, according to a different exemplary embodiment where the delivery valve is a pilot valve, which is piloted by the pressurized gas.

Alternatively, as shown in FIG. 2, device 100 provides, as pilot valve, delivery valve 25. This way, when coupling portion 10 couples with the pressurized gas supply, the gas enters at the same time inlet duct 21 and pilot channel 29 of the delivery valve. This way, the gas that has entered bottle 40' through inlet duct 21 causes the liquid to go up delivery duct 22 that is open, and through which it can exit by delivery mouth 23. Valve 24', which lets the gas to enter in bottle 40', can be operated for example, by a push button (not shown) present in the central body 20 of device 100, or in the pressurized gas supply.

Figure 3:
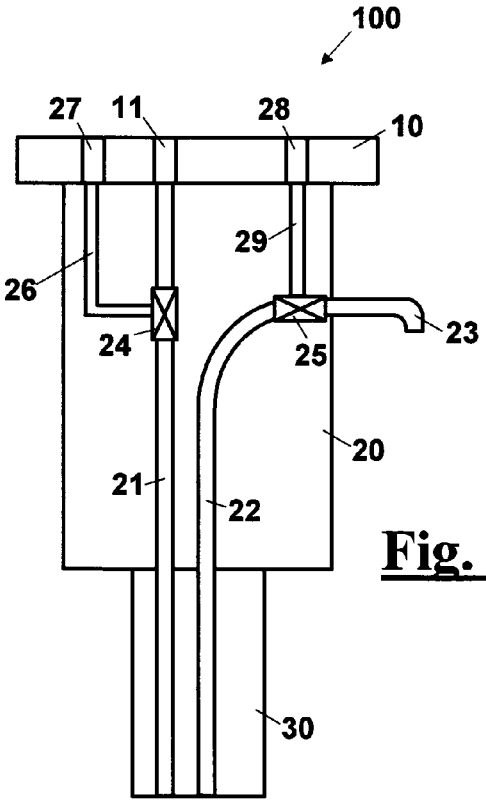
FIG. 3 shows diagrammatically the device for preserving and serving wine, in the preferred exemplary embodiment where both the inlet and delivery valves are piloted by the pressurized gas.

FIG. 3 shows a preferred exemplary embodiment where inlet valve 24 and delivery valve 25 are both pilot valves that are piloted by the pressure of the inert gas. In this exemplary embodiment, each pilot valve comprises a respective pilot channel indicated as 26 and 29 communicating with a respective pilot port 27 and 28. This way, the pressurized gas enters at the same time both in inlet duct 21, through inlet port 11, and in the two pilot channels 26 and 29, through the respective pilot ports 27 and 28, which open inlet duct 21 and liquid delivery duct 22.

Figure 4:
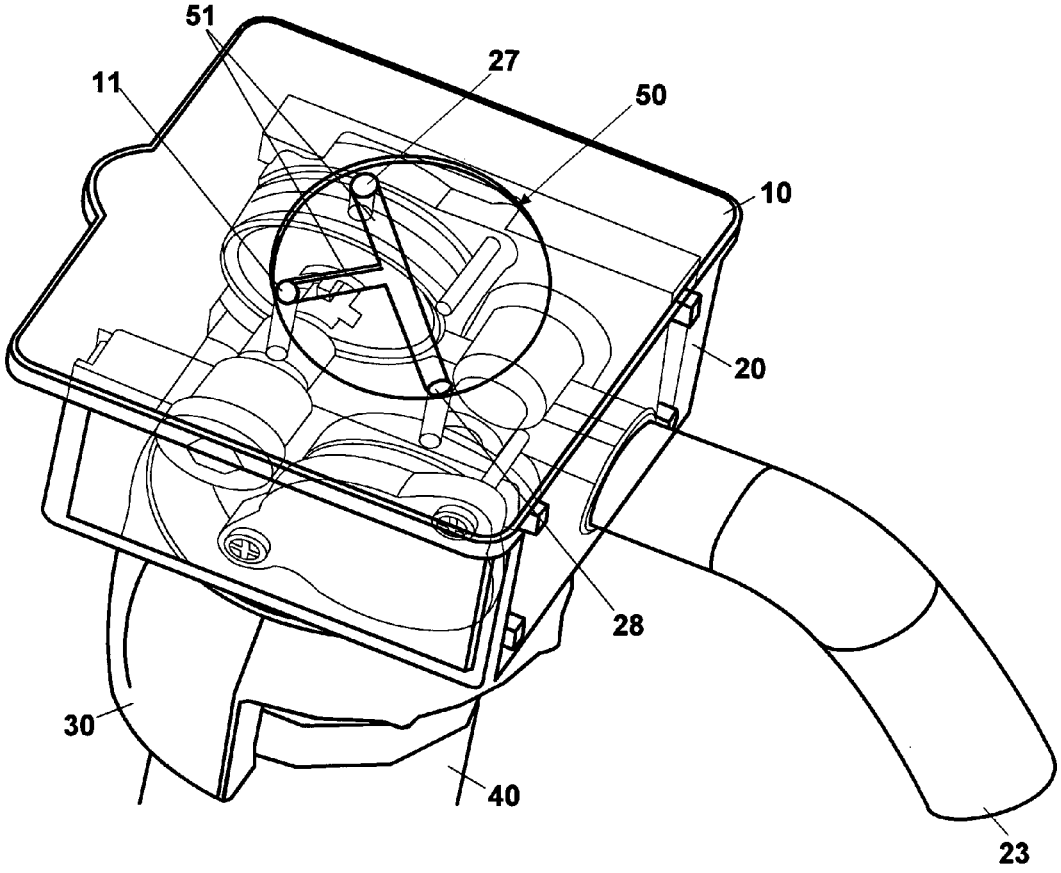
FIG. 4 shows a perspective view of the device of preserving and serving wine according to a preferred construction in the exemplary embodiment of FIG. 3.

FIG. 4 shows a perspective view of the device 100 in which, in particular, the inlet ports of duct 21 and the piloted ducts 27 and 28 of the pilot valves are shown. The latter, integrally to mouth 11 of inlet duct 21, are connected by grooves 51 made in a recess 50 of the coupling portion 10. this solution improve the distribution of the inert gas once connected to the gas supply (shown in FIG. 8), since the gas flows in the grooves 51 up to reaching the inlet ports of valves 24 and 25. Furthermore, it ensures a tight connection that avoids leaks of inert gas.

Figure 5:
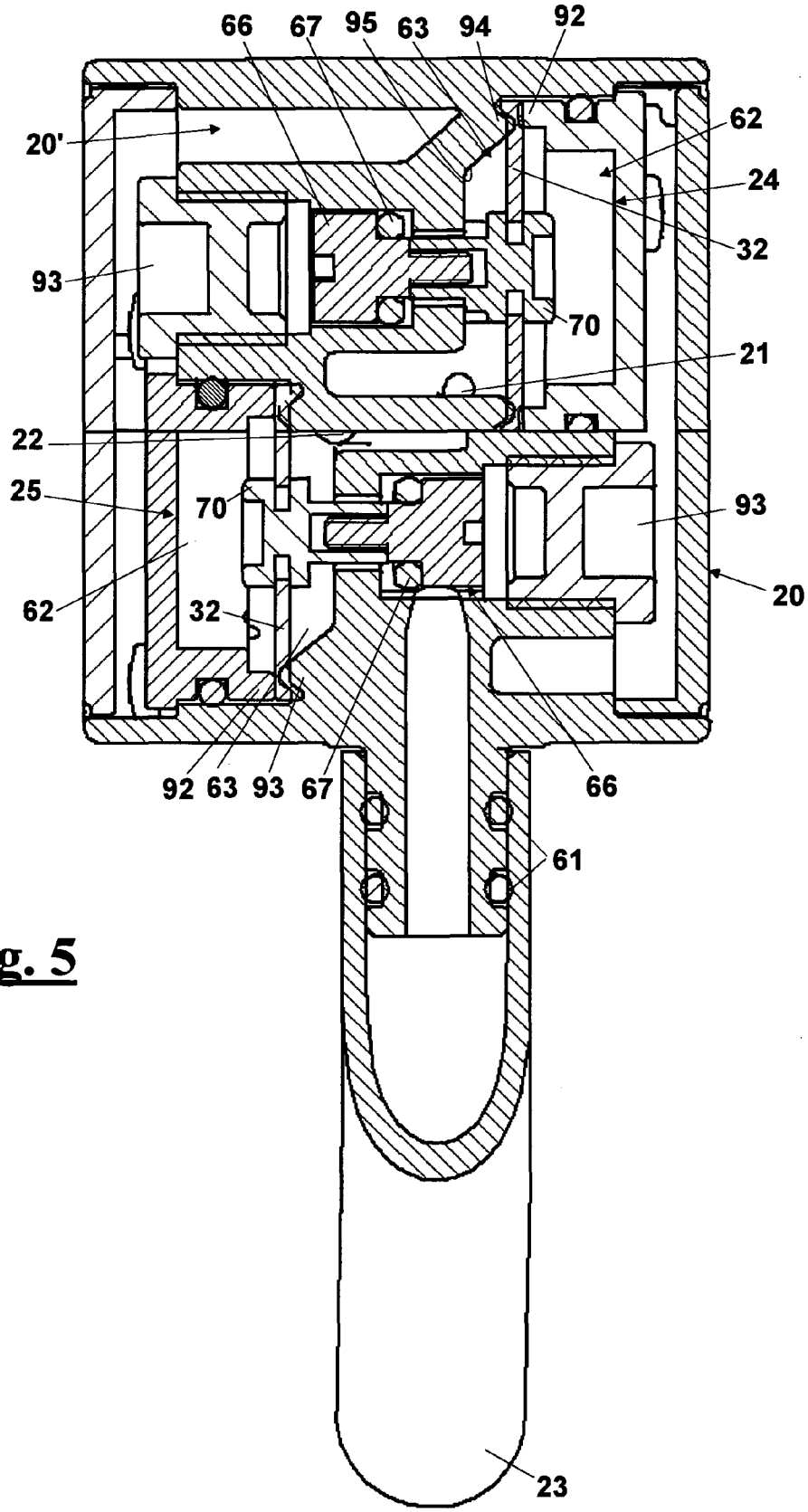
FIG. 5 shows a cross sectional view of the device, according to the invention, which shows the two pilot valves arranged respectively in the inlet duct and in the delivery duct.
Figure 5:
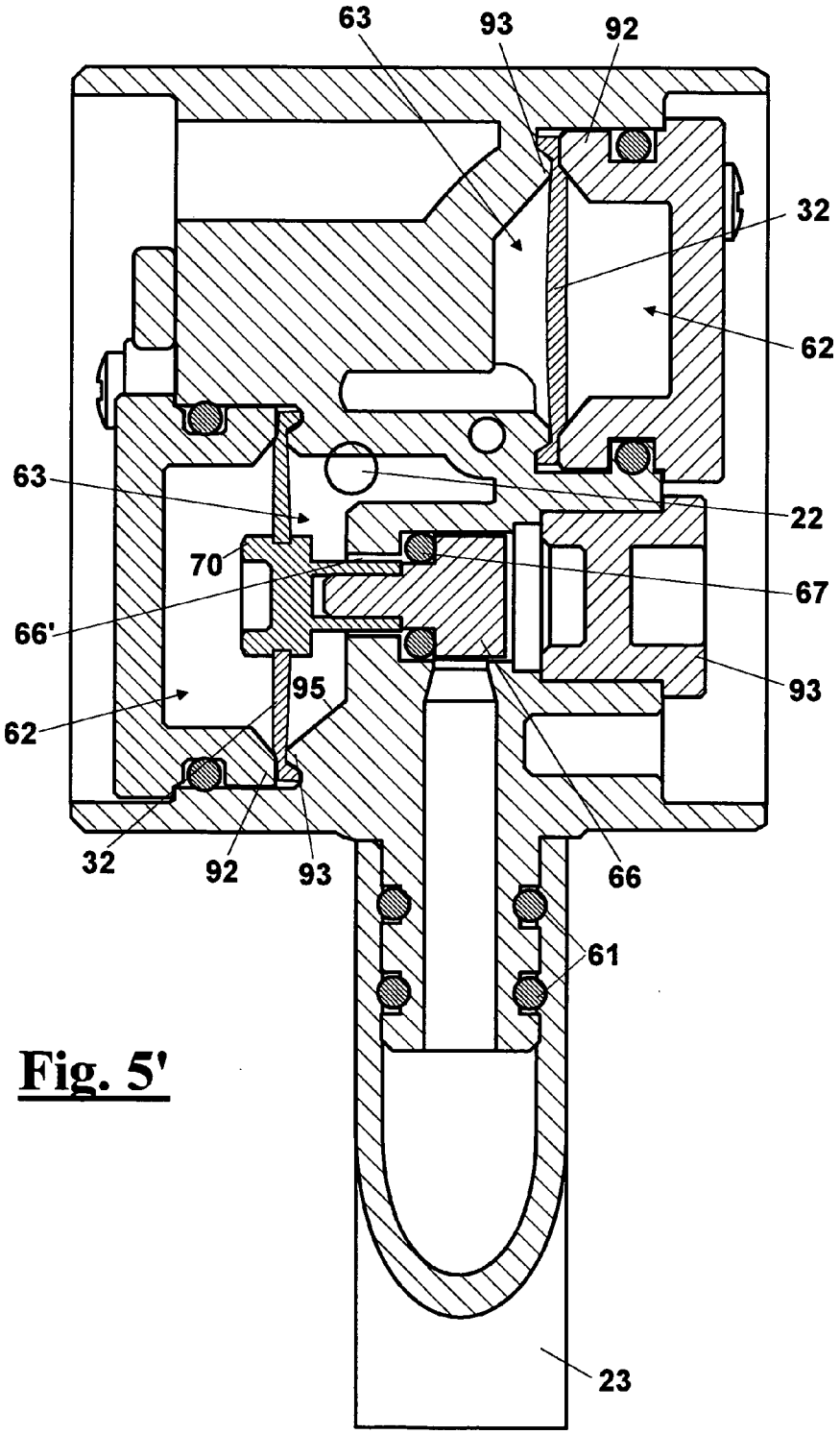

As shown in FIGS. 5 and 5', a cross sectional view of the two gas piloted valves 24 and 25 is shown, according to two different planes, each of them comprising a first chamber 62, connected to the respective pilot duct 26 or 29, a second chamber 63, connected to inlet duct 21 or to delivery duct 22, a membrane 32 separating first chamber and second chamber 63, and a stopper 66 arranged in second chamber 63 and blocking membrane 32.

In particular, central body 20 is a box-like body with a housing 20' having a shoulder 92 such that first chamber 62 and second chamber 63 are obtained arranging membrane 32 on shoulder 92. Furthermore, a plug 93 is provided that tightly engages in housing 20' and has a recess 95 and an edge 94, such that, in a closed position of plug 93, in housing 20' the edge 94 presses membrane 32 against shoulder 92. Therefore, first chamber 62 is formed by recess 95, whereas second chamber 63 is formed by the other part of housing 20' located beyond membrane 32.

In addition, housing 20', at the side of second chamber 63, has a hole 66' where stopper 66 engages, and beyond hole 66' a passage is present that represents a portion of inlet duct 21 and/or delivery duct 22 that stopper 66 selectively opens or blocks. In particular, stopper 66 has a portion 70 welded to membrane 32 and an o-ring 67 adapted exclusively to tightly close inlet duct 21 or delivery duct 22. The wine can thus exit from tube 23, mounted by means of o-ring 61 at the exit of delivery valve 25.

Figure 6:
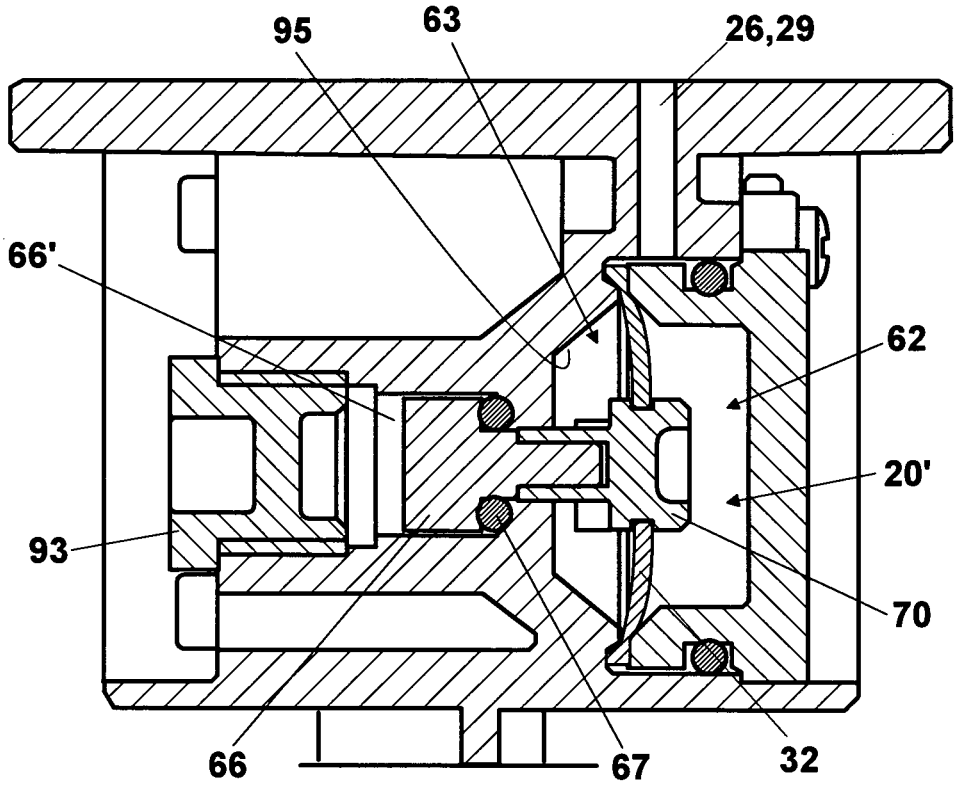
FIG. 6 shows a cross sectional view of a pilot valve by the inert gas showing the deformation of the membrane.

FIG. 6 shows membrane 32 arranged in one of pilot valves 24 or 25, in the configuration deformed by the pressure difference that is created between first chamber 62 and second chamber 63 by the introduction of the gas through the duct 26. This way, stopper 66 moves from a first position that opens inlet duct 21, to a second position that blocks inlet duct 21.

Similarly, the pressure difference between first chamber 62 and second chamber 63 by the introduction of the gas through the pilot duct 29, moves stopper 66 from a first position that opens delivery duct 22, to a second position that blocks delivery duct 22 (shown in FIG. 5').

Figure 7:
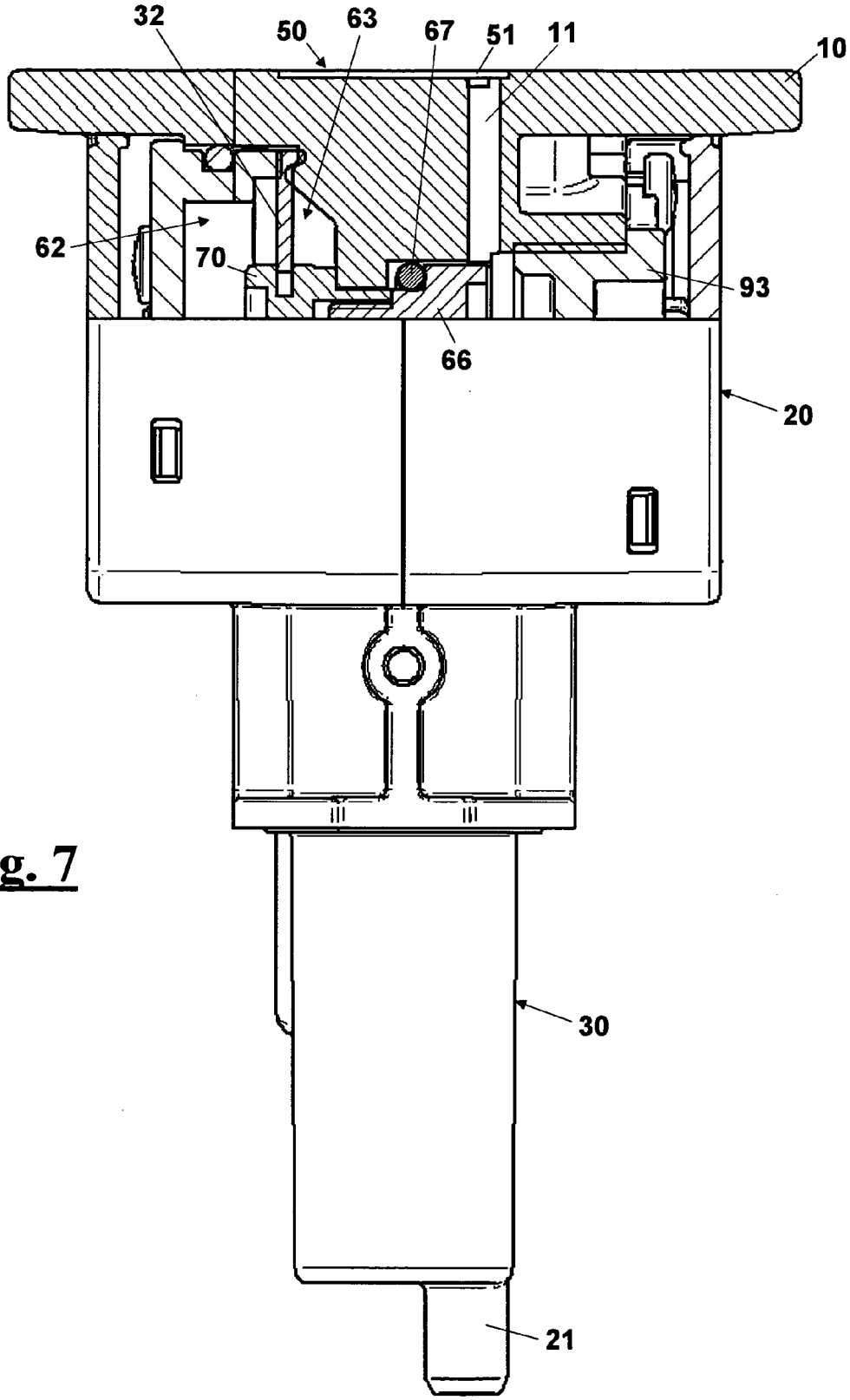
FIG. 7 shows a of the device on the coupling portion, which is adapted to couple with the supplier of gas.
Figure 7:
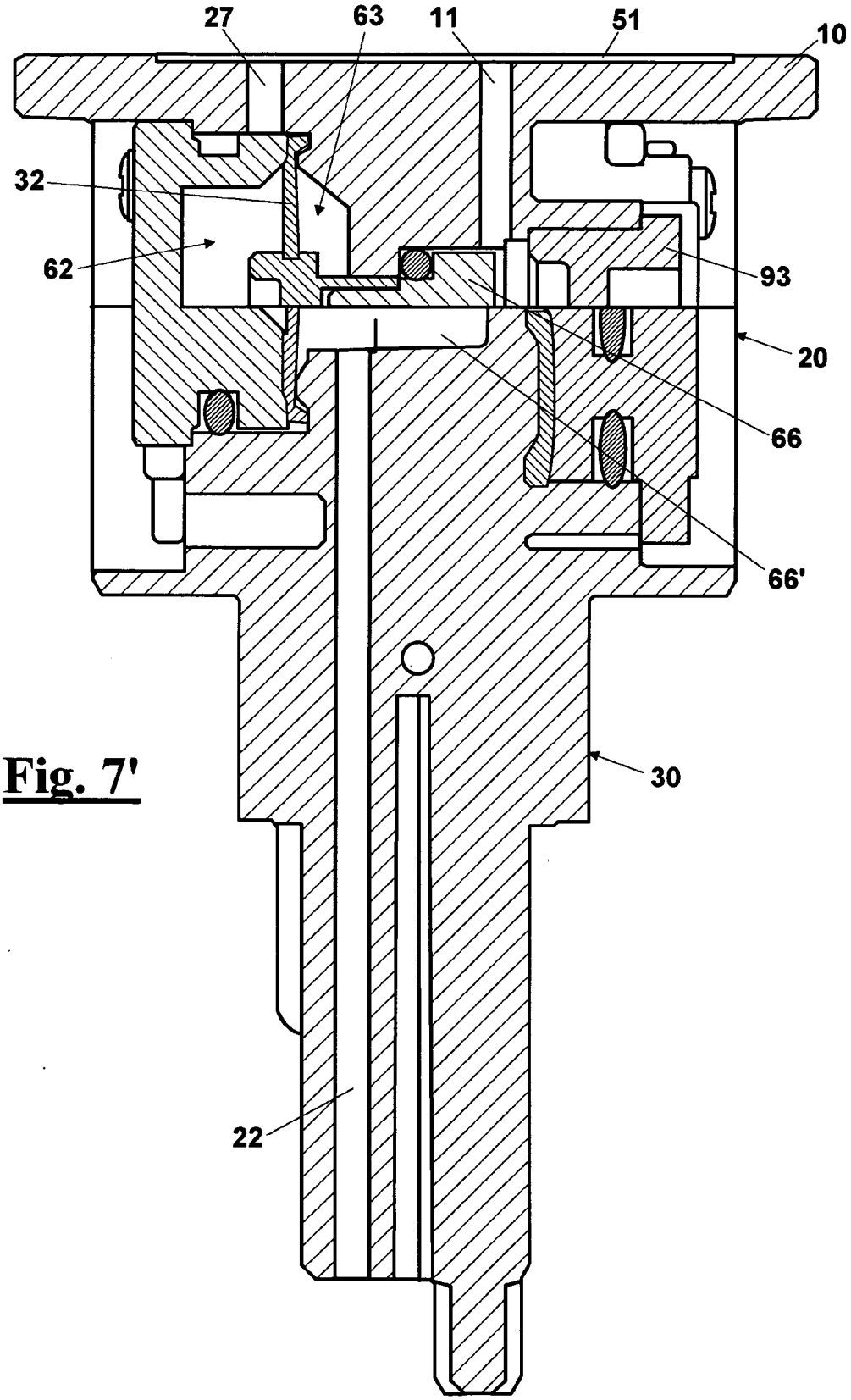

FIG. 7 shows a partially cross sectional view of the device 100 according to a plane passing through the mouth 11 that connects to inlet pilot valve 24 that, operated by the pressurized gas, opens stopper 66 and allows a pneumatic connection between mouth 11 and the gas inlet duct 21 (shown partially in FIG. 5).

FIG. 7' shows a cross sectional view of the device 100 with a plane passing through pilot port 27 and inlet port 11. Furthermore, this cross section shows a partial view of hole 66' where stopper 66 engages, the latter connected in turn to wine delivery duct 22 which ends with delivery thin tube 23.

FIG. 8 shows the supply machine 110 of inert gas, in a preferred exemplary embodiment, to which coupling portion 10 can be tightly connected, in particular the coupling portion being a flange 10 that slidingly engages with a guide 71 made in the pressurized gas supply device 110, such that flange 10 aligns with pilot ports 27, 28 and inlet port 11 enables the flow of the gas.

Furthermore, the figure shows bottle 40', a grid 192 for collecting possible droplets, a reservoir of gas 141 (or a corresponding reservoir-holder) and the push-button 191 that commands the flow of the gas, for serving the wine. This way, the gas in bottle 40' lets the wine to keep its best qualities, and the presence of the flange 10 that slidingly engages with guide 71 in order to serve it when desired.

The foregoing description of a specific embodiment will so fully reveal the invention according to the conceptual point of view, so that others, by applying current knowledge, will be able to modify and/or adapt for various applications such an embodiment without further research and without parting from the invention, and it is therefore to be understood that such adaptations and modifications will have to be considered as equivalent to the specific embodiment. The means and the materials to realise the different functions described herein could have a different nature without, for this reason, departing from the field of the invention. It is to be understood that the phraseology or terminology employed herein is for the purpose of description and not of limitation.

The invention claimed is:

1. Apparatus for preserving and serving from a bottle by-the-glass liquid that can be affected by oxygen, in particular wine, by pumping pressurized inert gas into said bottle, said bottle having a neck with an inlet mouth, said device comprising:

a coupling portion adapted to couple with a pressurized gas supply, a central body, and a fastening portion to said bottle adapted to engage with said inlet mouth, said body having:

a pressurized gas inlet duct, ending in said bottle, communicating with an inlet port present on said coupling portion, and a liquid delivery duct, which draws the liquid from the bottle and brings it to a delivery mouth, wherein to said inlet duct an inlet valve is associated, adapted to open said inlet duct when delivery of liquid is requested and to stop said inlet duct and to prevent the inert gas flow when delivery of liquid is not requested, and wherein to said delivery duct a delivery valve is associated, adapted to open said delivery duct when delivery of liquid is requested and to stop said delivery duct and to prevent the liquid to exit from the bottle when delivery of liquid is not requested, wherein at least one among said inlet valve and said delivery valve is a pilot valve that is piloted by the pressure of said inert gas, and wherein a pilot channel is provided communicating with a pilot port present in said coupling portion and communicating with said pilot valve.

2. A device, according to claim 1, wherein said valve piloted by the pressure of said inert gas is said inlet valve.

3. A device, according to claim 1, wherein said valve piloted by the pressure of said inert gas is said delivery valve.

4. A device, according to claim 1, wherein both said inlet valve and said delivery valve are valves piloted by the pressure of the inert gas, having each a respective pilot channel communicating with a respective pilot mouth.

5. A device, according to claim 1, wherein said pilot valve comprises:

a first chamber connected to said pilot duct from which the gas is inserted;

a second chamber connected to said inlet duct and/or with said delivery duct;

a membrane arranged between said first and second chamber;

a stopper arranged in said second chamber and integral to said membrane, such that said membrane deforms by the pressure difference between said first and second chamber and moves said stopper from a first position that opens said inlet duct and/or said delivery duct, to a second position that blocks said inlet duct and/or said delivery duct.

6. A device, according to claim 5, wherein said central body is a box-like body with a housing having a shoulder, said first and second chamber being obtained arranging said membrane on said shoulder, said first chamber being obtained from a plug that tightly engages in said housing and has a recess and an edge, such that in closed position of said plug in said housing said edge presses said membrane against said shoulder, and said first chamber is formed by said recess, whereas the second chamber is formed by the other part of said housing beyond said membrane.

7. A device, according to claim 6, wherein said housing from the side of said second chamber has a hole where said stopper engages, beyond said hole a pass being provided that represents a portion of said inlet duct and/or said delivery duct that said stopper selectively opens or blocks.

8. A device, according to claim 1, wherein said coupling portion comprises a flange that slidingly engages with a guide that is made in said pressurized gas supply such that said flange aligns with said inlet duct to enable said gas to pass.

9. A device, according to claim 1, where in said coupling portion a recess is made having a plurality of channels that in use connect the inlet port of said inlet duct and said pilot ducts.

* * * * *